US010006459B2

(12) United States Patent
Kobayashi

(10) Patent No.: US 10,006,459 B2
(45) Date of Patent: Jun. 26, 2018

(54) CLAW PUMP

(71) Applicant: ANEST IWATA Corporation, Kanagawa (JP)

(72) Inventor: Kenichi Kobayashi, Kanagawa (JP)

(73) Assignee: ANEST IWATA CORPORATION, Kanagawa (JP)

( * ) Notice: Subject to any disclaimer, the term of this patent is extended or adjusted under 35 U.S.C. 154(b) by 113 days.

(21) Appl. No.: 15/033,158

(22) PCT Filed: Nov. 6, 2014

(86) PCT No.: PCT/JP2014/079436
§ 371 (c)(1),
(2) Date: Apr. 29, 2016

(87) PCT Pub. No.: WO2015/068762
PCT Pub. Date: May 14, 2015

(65) Prior Publication Data

US 2016/0273539 A1 Sep. 22, 2016

(30) Foreign Application Priority Data

Nov. 6, 2013 (JP) ..... 2013-230096

(51) Int. Cl.
*F04B 17/00* (2006.01)
*F04C 18/18* (2006.01)
(Continued)

(52) U.S. Cl.
CPC ..... *F04C 28/24* (2013.01); *F04C 18/084* (2013.01); *F04C 18/123* (2013.01); *F04C 18/18* (2013.01);
(Continued)

(58) Field of Classification Search
CPC ..... F04C 2240/811; F04C 2270/185; F04C 28/10; F04C 28/16; F04C 28/24
See application file for complete search history.

(56) References Cited

U.S. PATENT DOCUMENTS 4,059,368 A 11/1977 McGahan et al.
4,639,199 A 1/1987 Frings et al.
(Continued)

FOREIGN PATENT DOCUMENTS

CN 2204007 7/1995
CN 1312437 9/2001
(Continued)

OTHER PUBLICATIONS

Extended European Search Report dated May 26, 2017 in corresponding European Application No. 14860625.4.
(Continued)

*Primary Examiner* — Mark Laurenzi
*Assistant Examiner* — Anthony Ayala Delgado
(74) *Attorney, Agent, or Firm* — Wenderoth, Lind & Ponack, L.L.P.

(57) ABSTRACT

A claw pump includes: a housing; two rotating shafts which are disposed parallel; a pair of rotors respectively fixed to the two rotating shafts; a rotary drive device driving the pair of rotors; and a suction port and discharge ports formed in a partition wall of the housing. The discharge ports are constituted by a first discharge port and a second discharge port. The first discharge port is formed at a position that communicates with an initial stage compression space formed at an initial stage of a compression stroke in a compression space that is formed by joining a first pocket and a second pocket. The claw pump includes an opening/closing mechanism which opens the first discharge port when a pressure of the initial stage compression space reaches a threshold and
(Continued)

closes the first discharge port when the pressure does not reach the threshold.

5 Claims, 5 Drawing Sheets

(51) Int. Cl.

| | |
|---|---|
| ***F04C 23/00*** | (2006.01) |
| ***F04C 28/24*** | (2006.01) |
| ***F04C 25/02*** | (2006.01) |
| ***F04C 28/16*** | (2006.01) |
| ***F04C 18/12*** | (2006.01) |
| ***F04C 18/08*** | (2006.01) |
| ***F04C 29/00*** | (2006.01) |
| *F04C 28/10* | (2006.01) |
| *F04C 29/12* | (2006.01) |

(52) U.S. Cl.

CPC ..... *F04C 25/02* (2013.01); *F04C 28/16* (2013.01); *F04C 29/0085* (2013.01); *F04C 28/10* (2013.01); *F04C 29/12* (2013.01); *F04C 2210/22* (2013.01); *F04C 2220/10* (2013.01); *F04C 2240/20* (2013.01); *F04C 2240/30* (2013.01); *F04C 2240/40* (2013.01); *F04C 2240/811* (2013.01); *F04C 2250/301* (2013.01); *F04C 2270/185* (2013.01)

(56) References Cited

U.S. PATENT DOCUMENTS

| | | | | |
|---|---|---|---|---|
| 4,737,082 | A * | 4/1988 | Glanvall | F04C 28/16 417/310 |
| 5,127,386 | A * | 7/1992 | Sowards | F02B 33/36 123/564 |
| 2011/0236232 | A1 | 9/2011 | Chu et al. | |

FOREIGN PATENT DOCUMENTS

| | | |
|---|---|---|
| JP | 60-45719 | 3/1985 |
| JP | 3-194184 | 8/1991 |
| JP | 7-243331 | 9/1995 |
| JP | 2011-38476 | 2/2011 |
| WO | 2013/046852 | 4/2013 |

OTHER PUBLICATIONS

International Search Report dated Jan. 27, 2015 in International (PCT) Application No. PCT/JP2014/079436.

English translation of International Preliminary Report on Patentability and Written Opinion of the International Searching Authority dated May 19, 2016 in International (PCT) Application No. PCT/JP2014/079436.

* cited by examiner

CLAW PUMP

TECHNICAL FIELD

The present invention relates to a claw pump which enables a reduction in power.

BACKGROUND ART

A claw pump includes a pair of rotors which have hook-shaped claws formed thereon and rotate in opposite directions to each other at the same speed in a non-contact manner while maintaining an extremely narrow clearance therebetween inside a housing that forms a pump chamber. The two rotors form a compression pocket, and compressed gas compressed in the compression pocket is discharged through a discharge port. The claw pump continuously performs suction, compression, and exhaust without using a lubricating oil or sealing liquid, thereby producing a vacuum state or pressurized air. As described above, since the lubricating oil or the like is not used, there are advantages that clean gas can be exhausted and discharged, and a higher compression ratio than that of a Roots pump that does not have a compression stroke can be realized.

FIG. 5 illustrates an example of a claw pump according to the related art. In FIG. 5, a claw pump 100 includes a housing 102 that forms a pump chamber therein, and the housing 102 has a cross-sectional shape of two partially overlapping circles. Both end faces of the housing 102 are blocked by side plates (not illustrated), and a suction port 108 is formed in a circumferential wall of the housing 102. Two parallel rotating shafts 110*a* and 110*b* are provided inside the housing 102, and rotors 112*a* and 112*b* are respectively fixed to the rotating shafts 110*a* and 110*b*. The rotors 112*a* and 112*b* are provided with hook-shaped claws 114*a* and 114*b* which mesh each other in a non-contact manner.

The rotors 112*a* and 112*b* rotate in opposite directions to each other (arrow directions), and gas g is suctioned into an inlet pocket $P_0$ that communicates with the suction port 108. Thereafter, a first pocket $P_1$ and a second pocket $P_2$ are formed as the rotors 112*a* and 112*b* rotate (see FIG. 5(D)). Furthermore, the first pocket $P_1$ and the second pocket $P_2$ join and form a compression pocket P (see FIG. 5(F)).

The compression pocket P is reduced as the rotors 112*a* and 112*b* rotate. A discharge port 116 is formed in one of the side plates at a position that communicates with the reduced compression pocket P. The gas g is compressed in the compression pocket P and is discharged from the discharge port 116.

In a case where the claw pump is used as a vacuum pump, during an operation at a suction pressure of atmospheric pressure, the pressures of the inlet pocket $P_0$, the first pocket $P_1$, and the second pocket $P_2$ are maintained substantially at the atmospheric pressure. During a compression stroke after the compression pocket P is formed, the compression pocket P reaches the atmospheric pressure or higher. When the pressure of the rotor on the downstream side in the rotational direction is higher than the pressure on the upstream side, counter torque is generated in the rotor in a direction opposite to the rotational direction of the rotor.

During an operation at a suction pressure of the ultimate pressure, the pressures of the inlet pocket $P_0$, the first pocket $P_1$, and the second pocket $P_2$ are maintained at the ultimate pressure (for example, about 7000 Pa [absolute pressure] although the ultimate pressure varies depending on the pump type). The pressure of the compression pocket P is maintained at the ultimate pressure until the discharge port 116 is open to the atmospheric pressure. However, when the discharge port 116 starts to be opened, air flows back to the compression pocket P and reaches the atmospheric pressure. Therefore, the pressure of the rotors 112*a* and 112*b* on the downstream side becomes higher than that on the upstream side, and the counter torque increases.

Patent Literature 1 discloses an example of a claw pump. A housing of the claw pump is constituted by a cylinder having a cross-sectional shape of two partially overlapping circles, and two side plates which block both ends of the cylinder. Discharge ports are provided at positions that are open to the compression pocket and are formed in both the side plates forming a pair in order to improve discharge efficiency.

CITATION LIST

Patent Literature

Patent Literature 1: Japanese Unexamined Patent Publication No. 2011-038476

SUMMARY OF INVENTION

Technical Problem

In a case where the claw pump is used as a vacuum pump, the pressure of gas to be suctioned ranges from the atmospheric pressure to the ultimate pressure (close to the vacuum pressure). During an operation at a suction pressure of about the ultimate pressure, the gas does not flow, and low energy is required to discharge the gas. In addition, when the discharge port is not open to the atmospheric pressure, the counter torque is low. However, when the discharge port is open to the air, the air flows back to the pump chamber in a vacuum state, and the pressure of the pump chamber on the downstream side of the rotor increases to close to the atmospheric pressure. Therefore, the counter torque increases and there is a problem in that the pump power increases. In order to avoid this, there is a need to reduce the area of the discharge port as small as possible to suppress the backflow of the air.

In a case where the suction pressure immediately after the start of the operation is close to the atmospheric pressure, a large amount of gas is discharged from the pump chamber. In order to discharge a large amount of gas without a pressure loss, the discharge port having a sufficiently large area is necessary. In addition, when the pressure loss increases, there is a problem in that the pump power increases. As described above, the requirements for the discharge port during the operation at a suction pressure of about the ultimate pressure and during the operation at a suction pressure of about the atmospheric pressure are conflict with each other. Therefore, both of the requirements cannot be satisfied, and the pump power cannot be reduced.

Although the claw pump disclosed in Patent Literature 1 has a configuration of the discharge port to increase discharge efficiency, the pump power cannot be reduced while satisfying the requirements.

In order to solve the above-described problems, an object of the present invention is to enable a reduction in pump power of a claw pump while satisfying conflicting requirements of a discharge port.

Solution to Problem

In order to accomplish the object, the present invention is applied to a claw pump including: a housing which forms a pump chamber having a cross-sectional shape of two partially overlapping circles; two rotating shafts which are disposed parallel to each other inside the housing and are synchronously rotated in opposite directions to each other; a pair of rotors which are respectively fixed to the two rotating shafts inside the housing and are provided with hook-shaped claws meshing with each other in a non-contact state; a rotary drive device which drives the pair of rotors so as to be rotated via the two rotating shafts; and a suction port and discharge ports which are formed in a partition wall of the housing and communicate with the pump chamber.

According to an aspect of the present invention, the discharge ports are constituted by a first discharge port and a second discharge port, the first discharge port is formed at a position that communicates with an initial stage compression space formed at an initial stage of a compression stroke in a compression space that is formed by joining a first pocket defined by one of the pair of the rotors and the partition wall of the housing and a second pocket defined by the other of the pair of rotors and the partition wall of the housing, and the second discharge port is formed at a position that communicates with an end stage compression space formed at an end stage of the compression stroke in the compression space. In addition, the first discharge port may include an opening/closing mechanism which opens the first discharge port when a pressure of the initial stage compression space reaches a threshold of atmospheric pressure or higher and closes the first discharge port when the pressure of the initial stage compression space does not reach the threshold.

During an operation at a suction pressure of about atmospheric pressure, when the pump chamber reaches the threshold or higher at the initial stage of the compression stroke, a large amount of gas is discharged from the pump chamber through the first discharge port, and thus unnecessary compression of the gas can be avoided. Therefore, the first discharge port is formed in the partition wall of the housing at a position that communicates with the initial stage compression space formed at the initial stage of the compression stroke in the compression space that is formed by joining the first pocket and the second pocket.

In addition, in a case where the claw pump is used as a vacuum pump, during an operation at a suction pressure of about the ultimate pressure, the pressure of the initial stage compression space does not reach the threshold, and the first discharge port is closed by an opening/closing mechanism. Therefore, the backflow of air to the pump chamber can be prevented. Since the first discharge port operated as described above is provided, the generation of counter torque applied to the rotors can be prevented, and the pump power can be reduced. In addition, it is preferable that the opening area of the first discharge port is large. By increasing the area of the first discharge port, a pressure loss can be reduced, and the pump power can be reduced.

The second discharge port is used to discharge the gas during the operation at a suction pressure of about the ultimate pressure. The second discharge port is formed in the partition wall of the housing at a position that communicates with the end stage compression space formed at the end stage of the compression stroke in the compression space formed by joining the first pocket and the second pocket. Since the second discharge port is formed in the end stage compression space, a time for which the backflow of the air occurs can be shortened. Since the amount of the gas discharged from the second discharge port is small, the opening area thereof may also be small. Therefore, the opening area of the first discharge may be greater than that of the second discharge port.

The threshold of the opening/closing mechanism that opens and closes the first discharge port may be a value approximated by the atmospheric pressure. Accordingly, the first discharge port can be opened before the pressure of the initial stage compression space increases, and thus the generation of counter torque can be effectively prevented.

In addition, since the second discharge port is formed to communicate with the end stage compression space having an increased pressure, the backflow of the air is less likely to occur compared to the first discharge port. Therefore, the generation of counter torque can be prevented while the second discharge port is open.

In an aspect of the present invention, the first discharge port may be disposed at a position that communicates with the initial stage compression space closer to an upstream side in a rotational direction of the pair of rotors than the second discharge port. Accordingly, the first discharge port can be opened early in the initial stage of the compression stroke, and thus excessive compression of the gas can be relieved early.

In addition, in an aspect of the present invention, the housing may be constituted by a cylinder having a cross-sectional shape of two partially overlapping circles, and a pair of side plates which block both end faces of the cylinder in an axial direction of the rotating shafts. In addition, the first discharge port may be formed in the cylinder, and the second discharge port may be formed in one of the pair of side plates and is formed at a position that does not communicate with the initial stage compression space and communicates with the end stage compression space. As described above, since the second discharge port is formed in one of the side plates, there are advantages that the degree of freedom of disposition of the second discharge port can be increased and the second discharge port can be easily machined. In addition, since the second discharge port is disposed at a position that does not communicate with the initial stage compression space and communicates with the end stage compression space, the backflow of the air to the pump chamber can be effectively prevented.

According to an aspect of the present invention, the opening/closing mechanism may be constituted by a valve body which opens and closes the first discharge port and a spring member which applies an elastic force to cause the valve body to be biased in such a direction that the first discharge port is closed, and the elastic force of the spring member may be adjusted such that the first discharge port is opened when the pressure of the initial stage compression space reaches the threshold and the first discharge port is closed when the pressure of the initial stage compression space does not reach the threshold. Accordingly, the opening/closing mechanism can be simply implemented at a low cost.

Another aspect of the opening/closing mechanism may be constituted by a pressure sensor which detects the pressure of the initial stage compression space, a solenoid valve which opens and closes the first discharge port, and a control device which receives a detection value of the pressure sensor and controls operations of the solenoid valve to open the first discharge port when the pressure of the initial stage compression space reaches the threshold and to close the first discharge port when the pressure of the initial stage compression space does not reach the threshold. Accordingly, there are advantages that the first discharge port can be accurately controlled to be opened and closed using the threshold, and the threshold can be easily changed depending on the change in operational conditions of the claw pump.

Advantageous Effects of Invention

According to some aspects of the present invention, the pump power of the claw pump can be reduced by simple and low-cost means provided with the first discharge port and the second discharge port.

DESCRIPTION OF EMBODIMENTS

Figure 1:
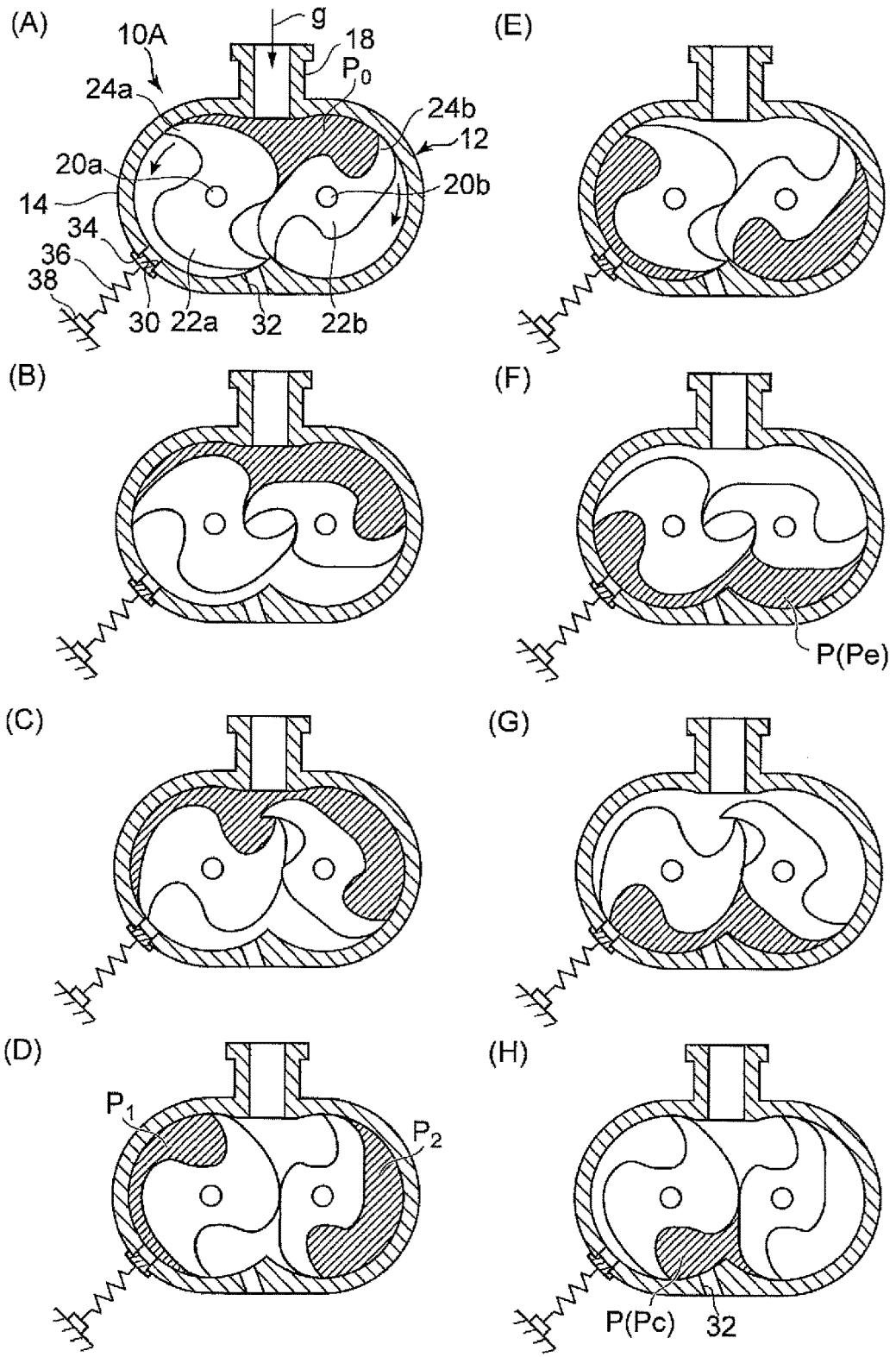
FIGS. 1(A) to 1(H) are front sectional views illustrating a claw pump according to a first embodiment of the present invention in a stroke order.

Hereinafter, the present invention will be described in detail using embodiments illustrated in the drawings. Here, the dimensions, materials, shapes, relative arrangements, and the like of components described in the embodiments are not intended to limit the scope of the invention thereto if not particularly defined.

First Embodiment

Figure 2:
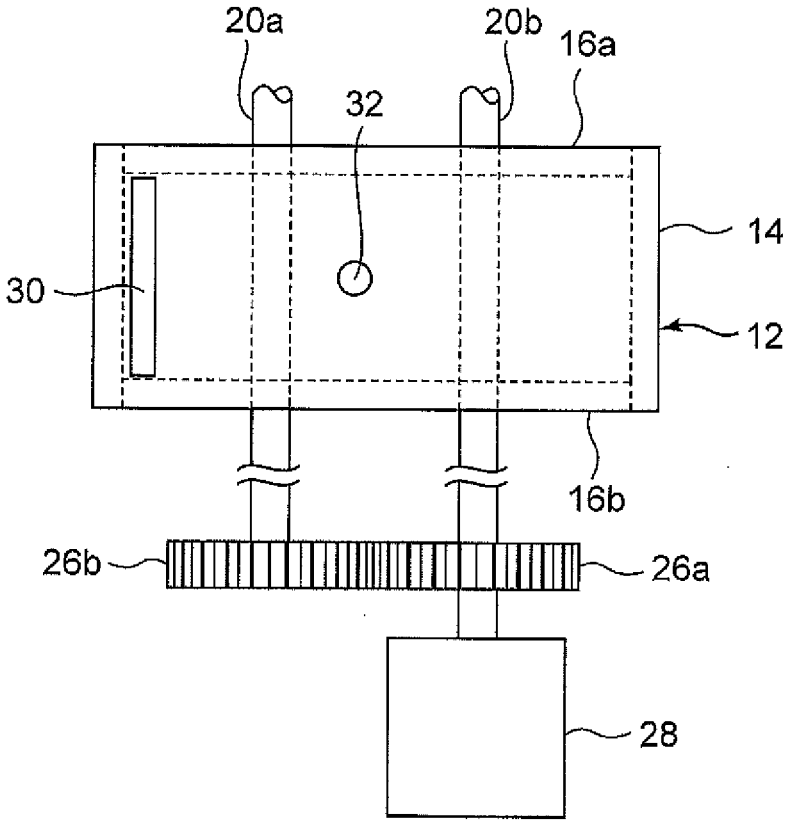
FIG. 2 is a bottom view of the claw pump.

Next, a claw pump according to a first embodiment of the present invention will be described with reference to FIGS. 1 and 2. In an example in FIGS. 1 and 2, a claw pump 10A according to the embodiment is used as a vacuum pump. A housing 12 that forms a pump chamber therein is included. As illustrated in FIG. 2, the housing 12 is constituted by a cylinder 14 having a cross-sectional shape of two partially overlapping circles, and a pair of side plates 16*a* and 16*b* which block both end faces of the cylinder 14. The cylinder 14 is provided with a suction port 18, and the suction port 18 is disposed at a position that communicates with an inlet pocket $P_0$ in which gas is not compressed. In other words, the cylinder 14 has a shape of two partially overlapping cylinders, and the suction port 18 is formed at a portion where a first cylindrical portion and a second cylindrical portion overlap.

Inside the housing 12, two rotating shafts 20*a* and 20*b* are arranged parallel to each other. Inside the housing 12, rotors 22*a* and 22*b* are respectively fixed to the rotating shafts 20*a* and 20*b*. The rotating shafts 20*a* and 20*b* extend toward the outside of the housing 12, and end portions of the rotating shafts 20*a* and 20*b* are provided with gears 26*a* and 26*b*. The gears 26*a* and 26*b* are rotated in the opposite directions to each other at the same speed by an electric motor 28. Therefore, the rotating shafts 20*a* and 20*b* are synchronously rotated in opposite directions to each other by the electric motor 28. The rotors 22*a* and 22*b* are rotated in the opposite directions to each other at the same speed by the electric motor 28. The rotating shaft 20*a* and the rotor 22*a* are accommodated in the first cylindrical portion. The rotating shaft 20*b* and the rotor 22*b* are accommodated in the second cylindrical portion.

The rotors 22*a* and 22*b* are provided with two claws 24*a* and two claws 24*b* which have a hook shape and mesh with each other in a non-contact state (with a fine gap therebetween). The two claws are disposed at opposite positions to each other in the circumferential direction.

The gas g is suctioned into the inlet pocket $P_0$ from the suction port 18 by the rotation of the rotors 22*a* and 22*b*. Next, the inlet pocket $P_0$ into which the gas g flows is divided into a first pocket $P_1$ enclosed by the housing 12 and the rotor 22*a*, and a second pocket $P_2$ enclosed by the housing 12 and the rotor 22*b* (see FIG. 1(D)). As the rotors 22*a* and 22*b* further rotate, the first pocket $P_1$ and the second pocket $P_2$ join such that a compression pocket P is formed (see FIG. 1(F)). Thereafter, the compression pocket P is reduced in size and the gas g is in the compression pocket P is compressed. In a series of stages of such a compression stroke, an initial stage compression space Pe is formed at an initial stage of the compression stroke (see FIG. 1(F)), and an end stage compression space Pc is formed at an end stage of the compression stroke (see FIG. 1(H)).

In the cylinder 14 that forms the circumferential wall of the housing 12, a first discharge port 30 and a second discharge port 32 are formed. In the cylinder 14, the first discharge port 30 and the second discharge port 32 are formed in the first cylindrical portion which is provided with the rotating shaft 20*a* and the rotor 22*a* and are formed on the opposite side to the suction port 18 with respect to a plane that passes through the rotating shafts 20*a* and 20*b*. The first discharge port 30 is disposed at a position that communicates with the initial stage compression space Pe formed immediately after the first pocket $P_1$ and the second pocket $P_2$ join (see FIG. 1(F)). In addition, the first discharge port 30 is disposed at a position that communicates with a region on the upstream side in the rotational direction of the rotor in the initial stage compression space Pe. More specifically, the first discharge port 30 is provided on the upstream side in the rotational direction of the rotor (that is, on the opposite side to the rotating shaft 20*b*) with respect to a virtual plane which is a virtual plane that passes through the rotating shaft 20*a* and is perpendicular to the plane that passes through the rotating shafts 20*a* and 20*b* (that is, parallel to the axis of the suction port 18). The second discharge port 32 is disposed at a position that communicates with the end stage compression space Pc which is formed in a stroke after the initial stage compression space Pe and has a narrower region than that of the initial stage compression space Pe (see FIG. 1(H)). More specifically, the second discharge port 32 is provided on the downstream side in the rotational direction of the rotor (that is, on the rotating shaft 20*b* side) with respect to the virtual plane.

As illustrated in FIG. 2, the first discharge port 30 has a rectangular shape with a long side having a length that is close to substantially the entire axial length of the cylinder 14 and a short side directed in the circumferential direction of the cylinder 14. The second discharge port 32 has a circular shape with a small diameter. The first discharge port 30 is formed to have a greater area than that of the second discharge port 32.

In addition, a valve body 34 which opens and closes the first discharge port 30 is provided. One end of a spring member 36 is connected to the rear surface of the valve body 34. The other end of the spring member 36 is connected to a fixed base 38. The spring member 36 is, for example, a compression spring and applies an elastic force to cause the valve body 34 to be biased in such a direction that the first discharge port 30 is closed. The elastic force of the spring member 36 is adjusted such that the first discharge port 30 is opened when the pressure of the initial stage compression space Pe is equal to or higher than the atmospheric pressure and is equal to or higher than a threshold (for example, 1.04 atm) of a value that is approximated by the atmospheric pressure and the first discharge port 30 is closed when the pressure of the initial stage compression space Pe is lower than the threshold.

When the initial stage compression space Pe is reduced in size and the pressure of the initial stage compression space Pe reaches the threshold or higher, the pressure of the initial stage compression space Pe becomes higher than the elastic force of the spring member 36 and presses the valve body 34 such that the first discharge port 30 is opened. Since the first discharge port 30 has a large opening area, the gas is discharged at a high flow rate at a time as the first discharge port 30 is opened. When the gas g is discharged from the first discharge port 30 and the pressure of the initial stage compression space Pe becomes lower than the threshold, the valve body 34 closes the first discharge port 30 by the elastic force of the spring member 36.

As the rotors 22*a* and 22*b* further rotate, the initial stage compression space Pe is reduced in size and the end stage compression space Pc is formed. Since the first discharge port 30 is closed, the gas g is discharged from the second discharge port 32 (see FIG. 1(H)).

According to this embodiment, when the pressure of the initial stage compression space Pe becomes higher than the threshold during an operation at a suction pressure of atmospheric pressure, the first discharge port 30 is opened and a large amount of gas g is discharged from the first discharge port 30. Therefore, unnecessary compression of the gas g can be avoided. Therefore, the generation of counter torque applied to the rotors 22*a* and 22*b* can be prevented, and the pump power can be reduced. In addition, since the first discharge port 30 has a large opening area, the pressure loss can be reduced, and accordingly, the pump power can also be reduced. Moreover, during an operation at a suction pressure of about the ultimate pressure, the pressure of the initial stage compression space Pe is low and thus the first discharge port 30 is closed. Therefore, the backflow of the outside air to the initial stage compression space Pe can be prevented.

During an operation at a suction pressure of about the ultimate pressure, the claw pump 10A discharges the gas g only from the second discharge port 32. Since the second discharge port 32 has a small opening area, the backflow of the air is less likely to occur. In addition, since the second discharge port 32 is formed in the end stage compression space Pc, a time for which the backflow of the air occurs can be shortened. Therefore, even while the second discharge port 32 is opened, the generation of counter torque can be prevented. In addition, during an operation at about the ultimate pressure, the flow rate of the discharged gas g is low, and the pressure loss can be suppressed. Therefore, even during an operation at about the ultimate pressure, the pump power can be reduced.

In addition, since the first discharge port 30 is disposed at a position that communicates with a region of the initial stage compression space Pe on the upstream side in the rotational direction of the rotor, the first discharge port 30 can be opened early in the initial stage of the compression stroke. Therefore, excessive compression of the gas can be relieved early. Furthermore, since the spring member 36 is used as an opening/closing mechanism of the first discharge port 30, the opening/closing mechanism can be implemented at a low cost.

Second Embodiment

Figure 3:
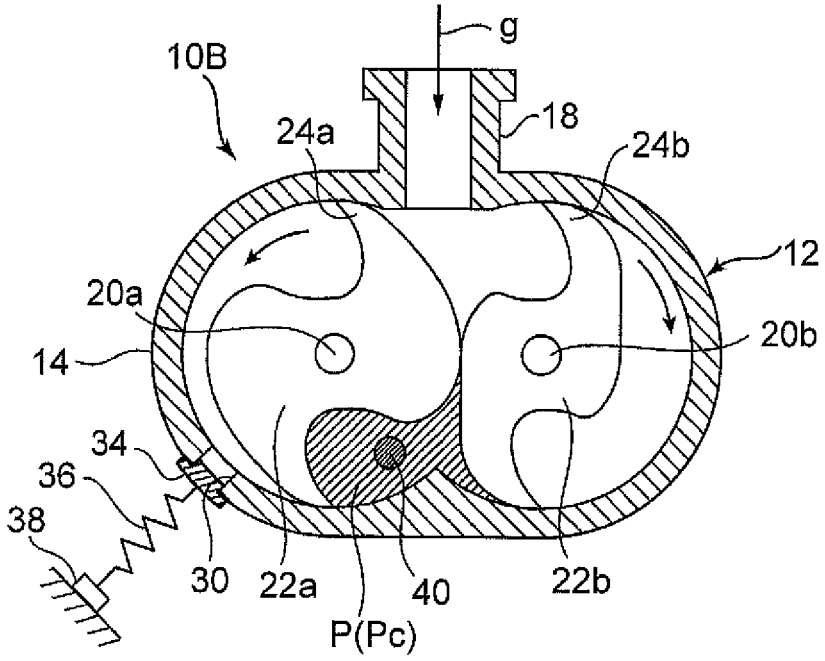
FIG. 3 is a front sectional view of a claw pump according to a second embodiment of the present invention.

Next, a second embodiment of the present invention will be described with reference to FIG. 3. A claw pump 10B of this embodiment is an example in which a second discharge port 40 is formed in any one of the side plates 16*a* and 16*b*. That is, the second discharge port 40 is formed in any one of the side plates 16*a* and 16*b* and is disposed at a position that does not communicate with the initial stage compression space Pe and communicates with the end stage compression space Pc. The second discharge port 40 is formed at a position corresponding to any end surface of the first cylindrical portion provided with the rotating shaft 20*a* and the rotor 22*a* in the cylinder 14. The shape, size, and the like of the second discharge port 40 are the same as those of the second discharge port 32 of the first embodiment.

According to this embodiment, in addition to the operational effects obtained by the claw pump 10A of the first embodiment, there are advantages that the degree of freedom of disposition of the second discharge port 40 can be increased and the second discharge port 40 can be easily machined. In addition, since the second discharge port 40 is formed in any one of the side plates 16*a* and 16*b* and is disposed at a position that does not communicate with the initial stage compression space Pe and communicates with the end stage compression space Pc, the backflow of the air to the pump chamber can be effectively prevented.

Third Embodiment

Figure 4:
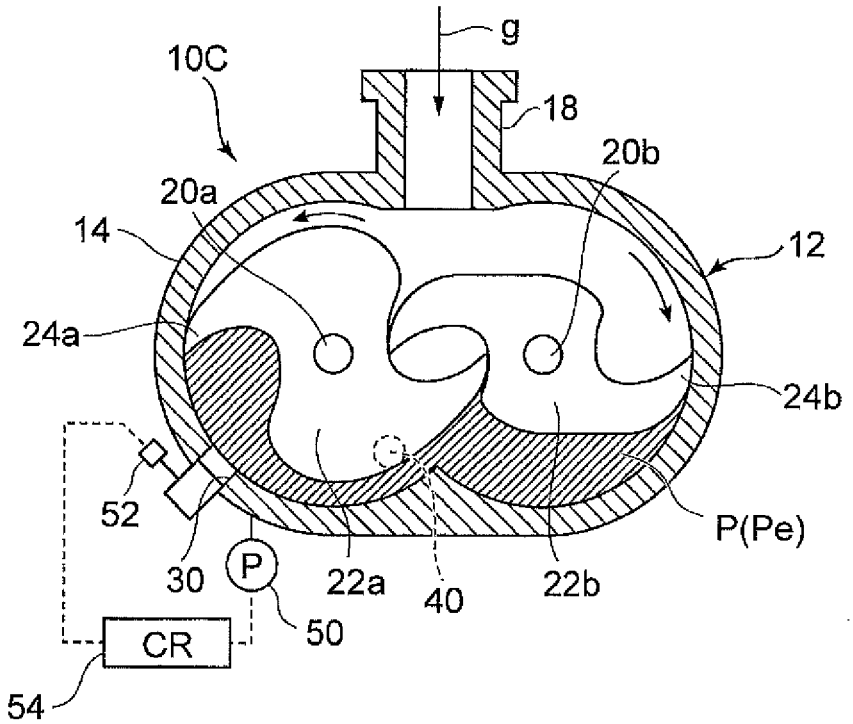
FIG. 4 is a front sectional view of a claw pump according to a third embodiment of the present invention.
Figure 5:
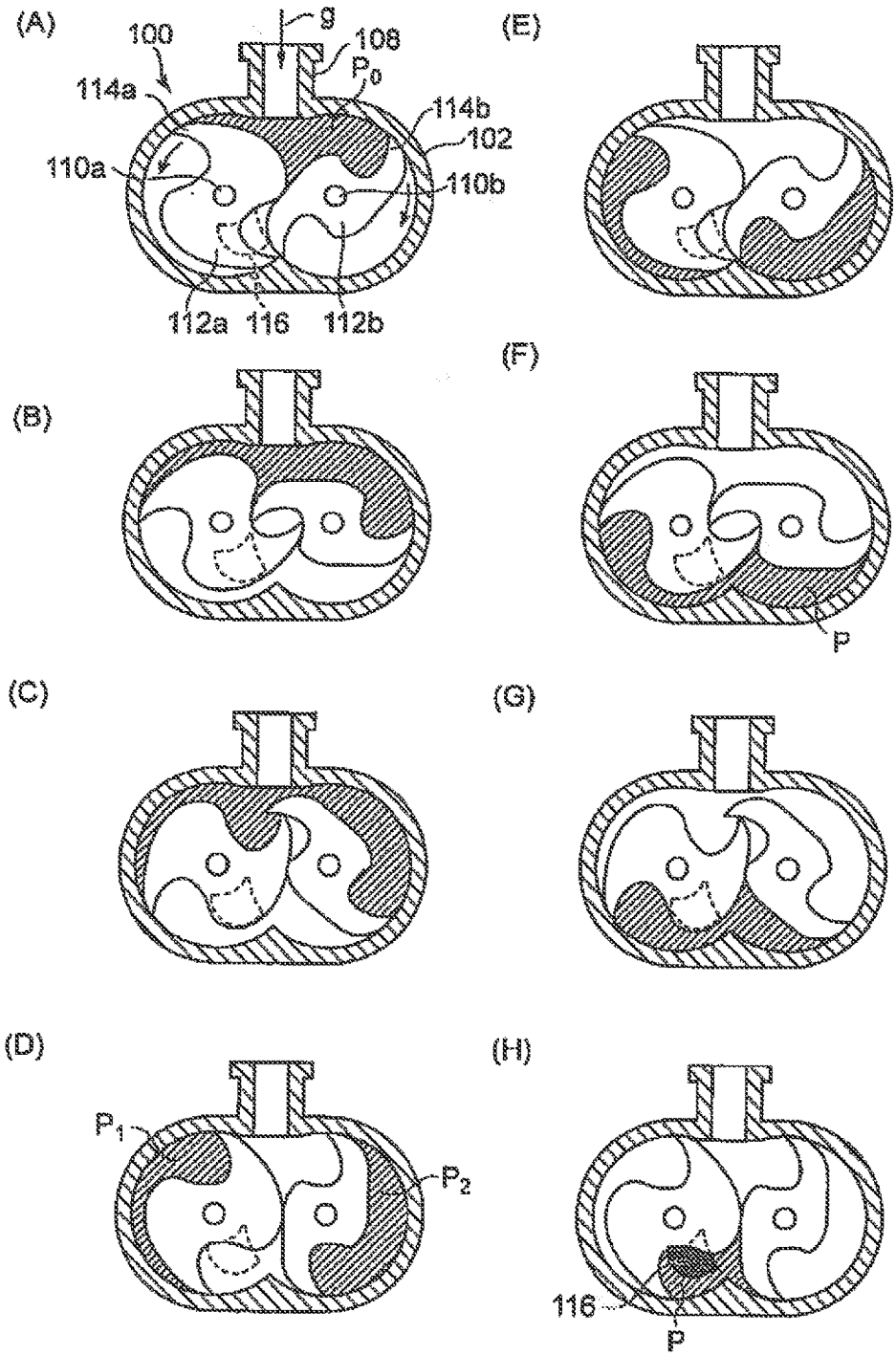
Fig.5 Prior Art
FIGS. 5(A) to 5(H) are front sectional views illustrating a claw pump according to the related art in a stroke order.

Next, a third embodiment of the present invention will be described with reference to FIG. 4. A claw pump 10C according to this embodiment is different from that of the second embodiment in the opening/closing mechanism for opening and closing the first discharge port 30. A opening/closing mechanism of this embodiment is constituted by a pressure sensor 50 which detects the pressure of the initial stage compression space Pe, a solenoid valve 52 which opens and closes the first discharge port 30, and a control device 54 which receives a detection value of the pressure sensor 50 and controls operations of the solenoid valve 52 to open the first discharge port 30 when the pressure of the initial stage compression space Pe reaches the threshold and to close the first discharge port 30 when the pressure of the initial stage compression space Pe does not reach the threshold. The other configurations are the same as those of the second embodiment.

In this configuration, the first discharge port 30 can be opened when the pressure of the initial stage compression space Pe reaches the threshold and the first discharge port 30 can be closed when the pressure of the initial stage compression space Pe does not reach the threshold by the control device 54. According to this embodiment, there are advantages that the first discharge port 30 can be accurately opened and closed using the threshold as the reference, and the threshold can be easily changed depending on the change in operational conditions of the claw pump 10C. In addition, the opening/closing mechanism of the third embodiment may be applied to the claw pump 10A of the first embodiment in which the first discharge port 30 and the second discharge port 32 are formed in the cylinder 14.

INDUSTRIAL APPLICABILITY

According to the present invention, a claw pump which can always reduce pump power with simple and low-cost means regardless of operational conditions.

REFERENCE SIGNS LIST

10A, 10B, 10C CLAW PUMP
12, 102 HOUSING
14 CYLINDER
16*a*, 16*b* SIDE PLATE
18, 108 SUCTION PORT
20*a*, 20*b*, 110*a*, 110*b* ROTATING SHAFT
22*a*, 22*b*, 112*a*, 112*b* ROTOR
24*a*, 24*b*, 114*a*, 114*b* CLAW
26*a*, 26*b* GEAR
28 ELECTRIC MOTOR
30 FIRST DISCHARGE PORT
32, 40 SECOND DISCHARGE PORT
34 VALVE BODY
36 SPRING MEMBER
38 FIXED BASE
50 PRESSURE SENSOR
52 SOLENOID VALVE
54 CONTROL DEVICE
100 CLAW PUMP
116 DISCHARGE PORT
P COMPRESSION POCKET
Pe INITIAL STAGE COMPRESSION SPACE
Pc END STAGE COMPRESSION SPACE
$P_0$ INLET POCKET
$P_1$ FIRST POCKET
$P_2$ SECOND POCKET
g GAS

The invention claimed is:

1. A claw pump comprising:

a housing comprising a cylinder having a cross-sectional shape of two partially overlapping circles and a pair of side plates, the housing forming a pump chamber having the cross-sectional shape of the two partially overlapping circles;

two rotating shafts which are disposed parallel to each other inside the housing and are synchronously rotated in opposite directions to each other;

a pair of rotors which are respectively fixed to the two rotating shafts inside the housing and are provided with hook-shaped claws meshing with each other in a non-contact state;

a rotary drive device which is configured to drive the pair of rotors so as to be rotated via the two rotating shafts;

a suction port which is formed at the cylinder of the housing and communicates with the pump chamber;

discharge ports which are formed at the side plates of the housing which block both end faces of the cylinder in an axial direction of the rotating shafts, the discharge ports configured to communicate with the pump chamber and comprising a first discharge port and a second discharge port, the first discharge port being formed at a position that communicates with an initial stage compression space formed at an initial stage of a compression stroke in a compression space that is formed by joining a first pocket defined by one of the pair of the rotors and the cylinder and the pair of side plates of the housing and a second pocket defined by the other of the pair of rotors and the cylinder and the pair of side plates of the housing, the second discharge port being formed at a position that communicates with an end stage compression space formed at an end stage of the compression stroke in the compression space;

a pressure sensor which detects the pressure of the initial stage compression space;

a solenoid valve which opens and closes the first discharge port; and a control device which receives a detection value from the pressure sensor and controls operations of the solenoid valve to open the first discharge port when the pressure of the initial stage compression space reaches a threshold of atmospheric pressure or higher and to close the first discharge port when the pressure of the initial stage compression space does not reach the threshold.

2. The claw pump according to claim 1, wherein an opening area of the first discharge port is greater than that of the second discharge port.

3. The claw pump according to claim 1, wherein the first discharge port is disposed at a position that communicates with the initial stage compression space closer to an upstream side in a rotational direction of the pair of rotors than the second discharge port.

4. The claw pump according to claim 1, wherein the suction port is formed at a portion of the cylinder corresponding to the two partially overlapping circles.

5. The claw pump according to claim 1, wherein the suction port is formed at the cylinder at a position that communicates with an inlet pocket in which gas is not compressed.

* * * * *